US007775010B2

(12) United States Patent
Lee et al.

(10) Patent No.: US 7,775,010 B2
(45) Date of Patent: Aug. 17, 2010

(54) SLAB BOLSTER COUPLING

(75) Inventors: Kenneth Lee, Anaheim, CA (US); Clifford D. Bennett, Fontana, CA (US)

(73) Assignee: Dayton Superior Corporation, Dayton, OH (US)

( * ) Notice: Subject to any disclaimer, the term of this patent is extended or adjusted under 35 U.S.C. 154(b) by 245 days.

(21) Appl. No.: 12/018,552

(22) Filed: Jan. 23, 2008

(65) Prior Publication Data

US 2008/0184656 A1 Aug. 7, 2008

Related U.S. Application Data

(60) Provisional application No. 60/886,181, filed on Jan. 23, 2007.

(51) Int. Cl.
*E04C 5/16* (2006.01)

(52) U.S. Cl. ..... 52/677; 52/687; 24/615

(58) Field of Classification Search ..... 52/677, 52/687, 688; 24/614, 615, 625
See application file for complete search history.

(56) References Cited

U.S. PATENT DOCUMENTS

| | | | | |
|---|---|---|---|---|
| 3,072,938 | A * | 1/1963 | Phaneuf | 15/22.1 |
| 3,200,464 | A * | 8/1965 | Cousins | 24/593.1 |
| 3,251,110 | A * | 5/1966 | Hedu | 24/616 |
| 3,529,392 | A | 9/1970 | Adams | |
| 4,942,714 | A | 7/1990 | Langley, Jr. et al. | |
| 5,664,390 | A | 9/1997 | Sorkin | |
| D393,997 | S | 5/1998 | Hartzheim | |
| 6,722,097 | B2 | 4/2004 | Haslem et al. | |
| 6,735,918 | B2 | 5/2004 | Haslem et al. | |
| 6,775,954 | B1 | 8/2004 | Sorkin | |
| 6,948,291 | B2 | 9/2005 | Haslem et al. | |
| 7,089,633 | B2 * | 8/2006 | Liu | 24/615 |

OTHER PUBLICATIONS

Product catalog of Seifert, p. 7 (Jun. 1976).
"Spacers for horizontal and vertical reinforcement," from product catalog of Seifert, pp. 12-13 (2007).
Official Action, Canadian Patent Application No. 2,618,872 (2 pages) (Sep. 30, 2009).
Office Action, Chinese Application No. 200810088130.X (3 pages) (Nov. 27, 2009).

* cited by examiner

*Primary Examiner*—Jeanette E Chapman
*Assistant Examiner*—Daniel Kenny
(74) *Attorney, Agent, or Firm*—Thompson Hine LLP

(57) ABSTRACT

In a first aspect, a plurality of slab bolster elements, each including a bolster frame member having a male connector disposed on a first end and a female connector disposed on an opposite end, with the male connector including first and second outer prongs for engaging a complementary female connector and the female connector including first and second opposing side walls with first and second transverse slats extending between the side walls so as to form a socket, the male connector further including a flexible prong extending inwardly between the outer prongs, with the flexible prong including a free inward end and a wedge element configured to resiliently contact and lockingly engage the first transverse slat of another of the plurality of slab bolster elements. In a second aspect, a continuous slab bolster assembly.

17 Claims, 3 Drawing Sheets

SLAB BOLSTER COUPLING

CROSS-REFERENCES TO RELATED APPLICATIONS

This application claims priority to U.S. Provisional Application Ser. No. 60/886,181, filed on Jan. 23, 2007, the entire contents of which are incorporated herein by reference.

BACKGROUND

This application is directed to a slab bolster for use in reinforced concrete construction, and more particularly, to a slab bolster coupling joining a plurality of slab bolster elements to form a continuous bolster of desired length.

Slab bolsters are relatively lightweight frame members that are positioned at spaced intervals on a deck or grade within a slab form to support concrete reinforcing bar, a.k.a. rebar, prior to the pouring of wet concrete. After placing the slab bolsters in position within the slab form, rebar may be positioned so as to extend between and across the support surfaces of parallel slab bolsters. Such slab bolsters are frequently attached to other similar bolsters in a linear relationship to form a continuous bolster extending across the width of the slab form.

Known slab bolster coupling mechanisms include those shown in U.S. Pat. Nos. 3,529,392 to Adams, 4,942,714 to Langley, Jr. et al., and 5,664,390 to Sorkin, each of which can be disassembled by a simple force acting opposite the direction of assembly. Therefore these types of slab bolsters must generally be assembled and maintained in place within a slab form. Known slab bolster coupling mechanisms also include buckle type couplings such as those shown in U.S. Pat. Nos. 6,735,918 and 6,948,291 to Haslem et al., which can resist forces acting opposite the direction of assembly and thus permit pre-assembly of a continuous bolster prior to installation within a slab form, but have been found require comparatively high insertion forces in order to resist unintentional disassembly during installation or repositioning, leading to fatigue during repeated assembly of constituent slab bolster elements. Thus there is a need for a simple-to-assemble coupling providing for greater ease of insertion with a similar degree of resistance to unintentional disassembly. Moreover, there is a need for a coupling providing for occasional intentional disassembly to minimize wastage.

SUMMARY

In a first aspect, a plurality of slab bolster elements, each including a bolster frame member having a male connector disposed on a first end and a female connector disposed on an opposite end, with the male connector including first and second outer prongs for engaging a complementary female connector and the female connector including first and second opposing side walls with first and second transverse slats extending between the side walls so as to form a socket for receiving a complementary male connector, the male connector further including a flexible prong extending inwardly between the outer prongs, with the flexible prong including a free inward end and a wedge element configured to, in use, resiliently contact and lockingly engage the first transverse slat of another of the plurality of slab bolster elements such that the male connector may lockingly engage the female connector of a second of the plurality of slab bolster elements when inserted into the female connector of that second slab bolster element.

In a second aspect, a continuous slab bolster assembly including a first bolster frame member having a male connector and a second bolster frame member having a female connector, with the male connector including first and second outer prongs projecting longitudinally within the female connector, and the female connector including first and second opposing side walls projecting longitudinally over the first and second outer prongs, respectively; with first and second transverse slats interconnecting the side walls on opposite sides of the outer prongs, the male connector further including a flexible prong extending inwardly between the outer prongs, with the flexible prong including a free inward end and a wedge element lockingly retained within said female connector by said first transverse slat.

DETAILED DESCRIPTION

Figure 1:
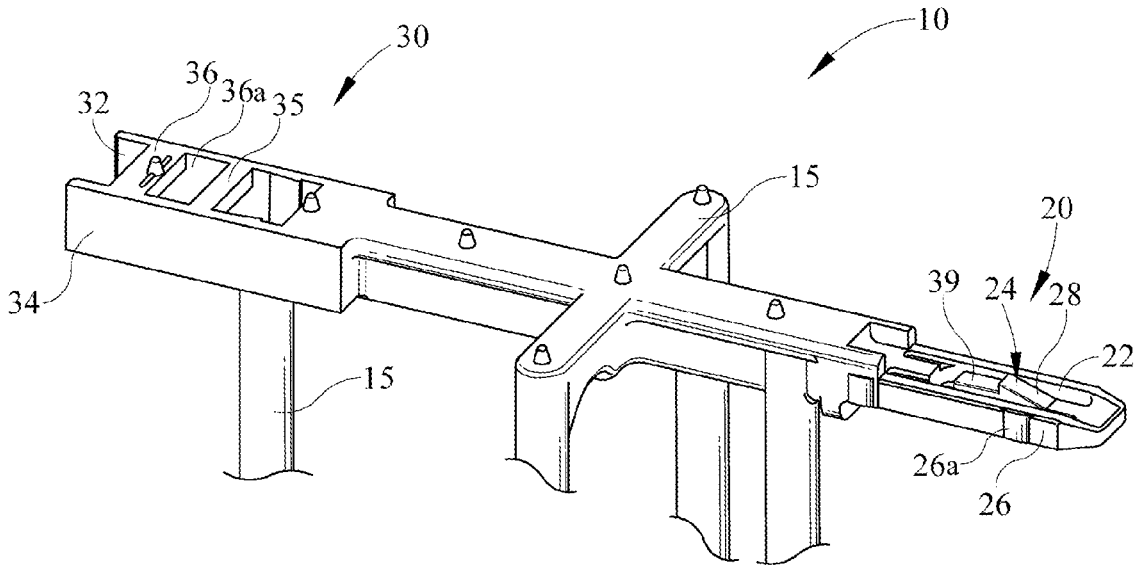
FIG. 1 is a perspective view of a slab bolster element including a male connector at one end and a cooperating female connector at an opposite end.
Figure 2:
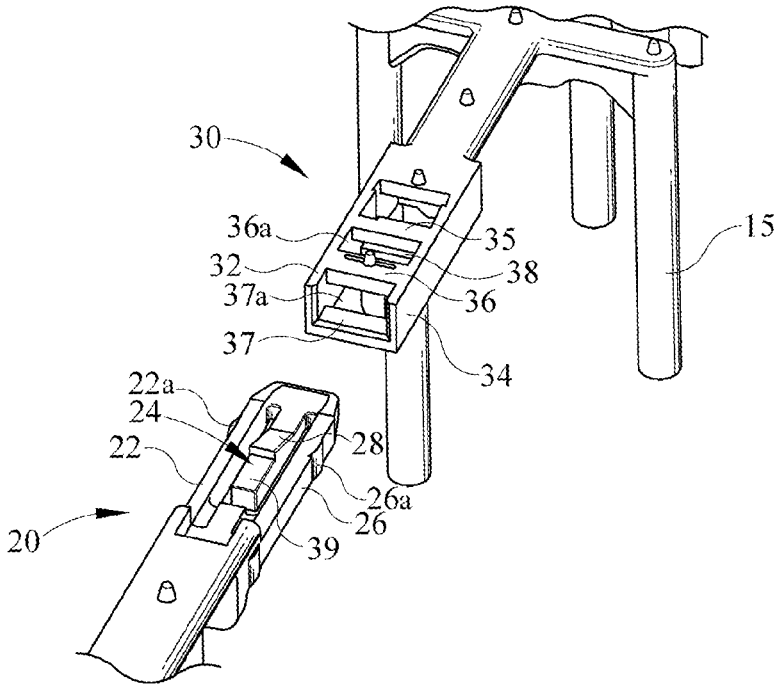
FIG. 2 is a perspective view of the slab bolster connectors of FIG. 1 aligned to be joined end to end.

As shown in FIGS. 1 and 2, a slab bolster element 10 includes a male connector 20 at a first end of a bolster frame member 15 and a cooperating female connector 30 at an opposite end. The male connector 20 includes first and second outside prongs 22, 26 projecting longitudinally outward from the first end. These prongs are optionally resilient, and may include projections 22*a*, 26*a* configured to, in use, lockingly engage the side walls of the cooperating female connector 30. A third, flexible prong 24 is mounted between the outer prongs 22, 26. The flexible prong 24 includes an inclined surface or wedge shaped element 28 and a free end 39 projecting inward toward the first end. The male connector 20 is shaped to engage the female connector 30 of an adjacent slab bolster element 10.

The female connector 30 could have a number of cross-sectional geometries, such as but not limited to oval, square, etc. In the illustrated embodiment, a rectangular cross-sectional construction is shown including side walls 32, 34 projecting longitudinally outward from the opposite end, as well as transverse upper third and first slats 35, 36 and transverse lower second and fourth slats 37, 38. Transverse upper third and first slats 35, 36 are separated by a longitudinal gap 36*a*, and transverse upper second and fourth slats 37, 38 are separated by a longitudinal gap 37*a*. With reference to FIG. 2, it will be seen that multiple slab bolster elements 10 may be joined end to end by complementary coupling elements 20, 30 along a shared longitudinal axis.

Figure 3:
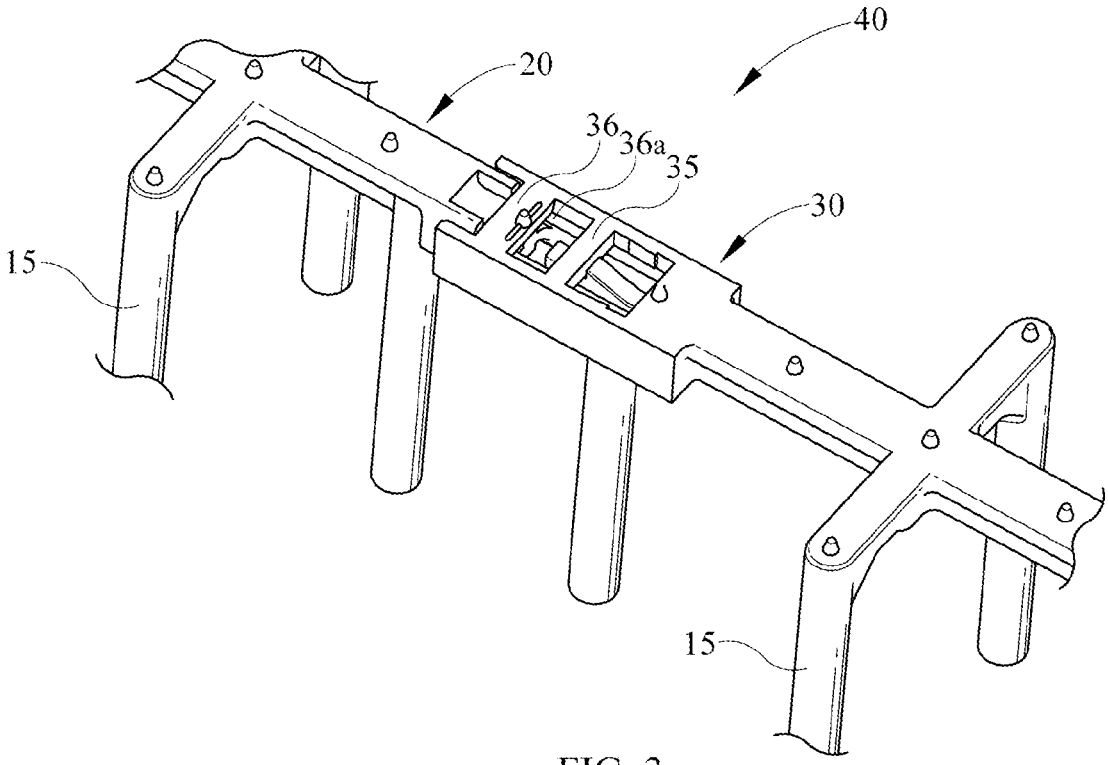
FIG. 3 is a perspective view showing the disclosed slab bolster coupling in an assembled state.

An assembled slab bolster coupling 40 is shown in FIG. 3, wherein the coupling 40 includes a male connector 20 joined to a female connector 30. The coupling 40 can be used with any bolster frame members 15, and in particular, the bolster frame members described in U.S. Utility Pat. No. 6,948,291 and U.S. Design Pat. No. 393,997, the entire contents of which are incorporated herein by reference. All non-destructive vertical loading, such as that created by the rebar placed on the bolster assembly and by the subsequent pouring of concrete, will be perpendicular to the coupling direction, and will not by itself open the coupling 40. All non-destructive longitudinal loading, such as that created by carrying a pre-assembled continuous slab bolster for installation within a slab form, will be opposed by at least engagement between the wedge shaped element 28 and transverse slats 36, 35, as described in further detail below.

Figure 4:
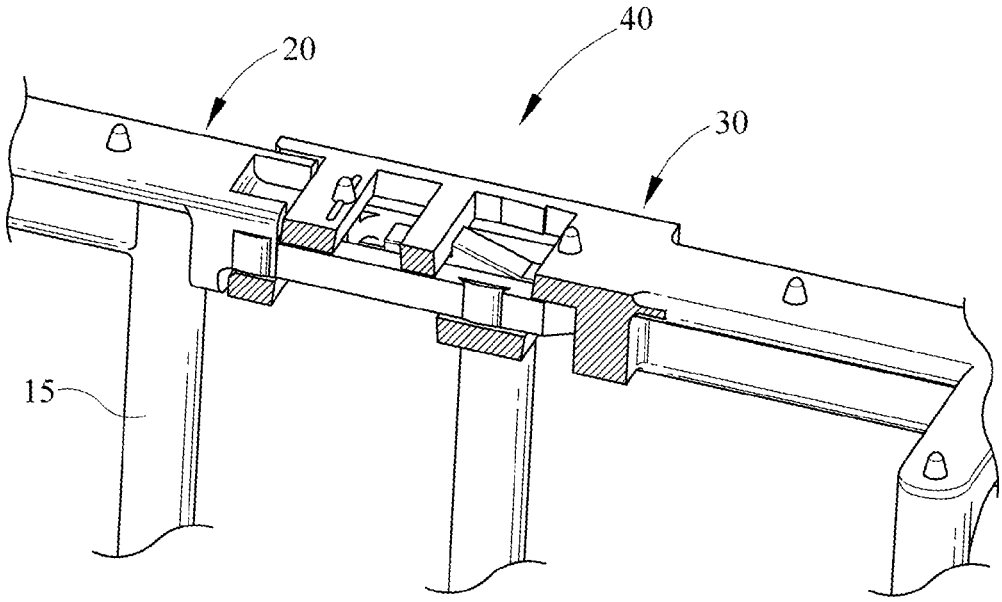
FIG. 4 is a perspective cut-away view of FIG. 3.

An operational example for assembling the disclosed slab bolster coupling follows. When inserted into the female connector 30, the wedge shaped element 28 on the flexible prong 24 sequentially contacts transverse upper first and third slats 36 and 35, and the flexible prong 24 is forced downward until the wedge 28 advances beyond each respective slat 36, 35. Thereafter, the flexible prong 24 snaps back upwardly into position to prevent the unintentional decoupling or disassembly of the slab bolster coupling 40, as illustrated in FIGS. 3-5.

Figure 5:
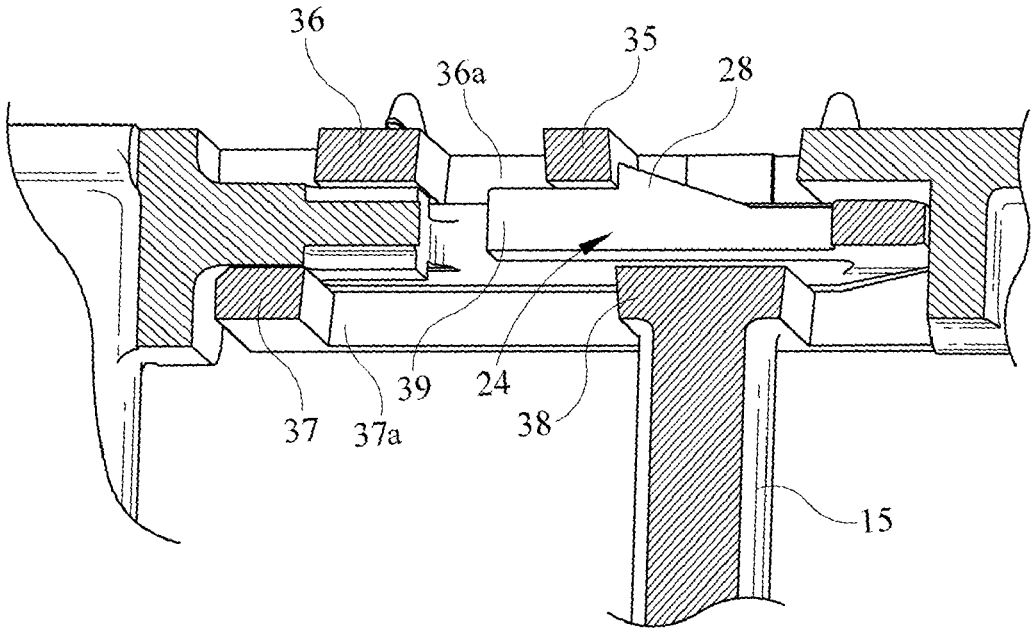
FIG. 5 is an elevational cut-away view of FIG. 3.
Figure 6:
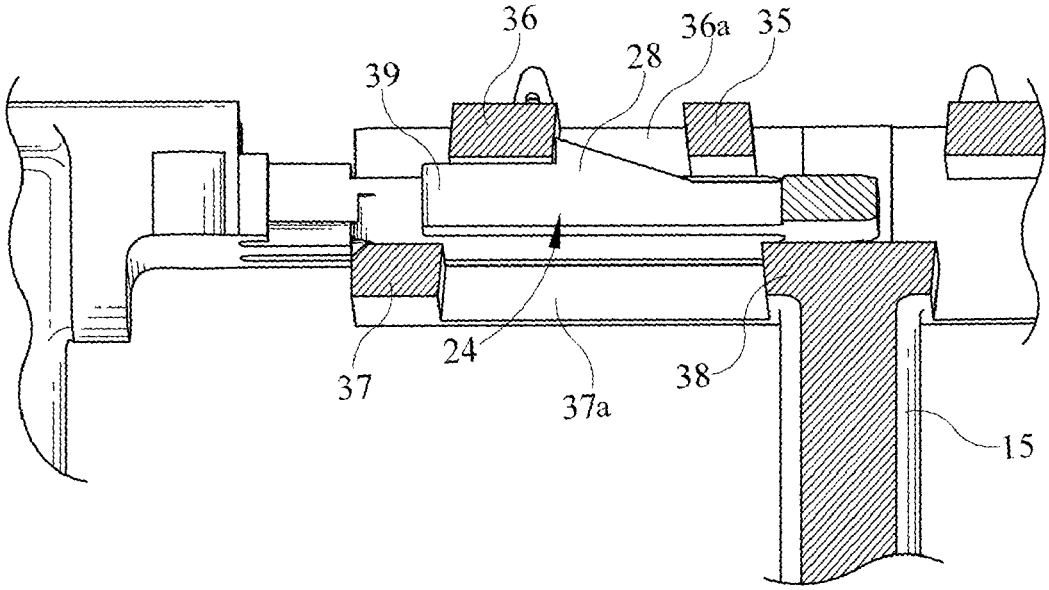
FIG. 6 is an elevational cut-away view showing the slab bolster coupling of FIG. 5 in a partially disassembled state.

As illustrated in FIG. 5, to disassemble the slab bolster coupling 40 requires an applied vertical force to push the flexible prong 24 down to allow the wedge shaped element 28 to pass under transverse upper third slat 35 as well as transverse upper first slat 36. The wedge shaped element 28 must pass under both transverse upper slats 35, 36 in order to fully disassemble the male connector 20 from the female connector 30. The likelihood that the bolster could be inadvertently dissassembled is minimal because the wedge shaped element 28 of the flexible prong 24 will not pass under the transverse upper slats 35, 36 if prong 24 is pushed by an insufficient force, and the free end 39 of the flexible prong 24 will blockingly abut transverse lower second slat 37 if prong 24 is depressed too deeply. Moreover, in order to fully disassemble the partially disassembled slab bolster coupling shown in FIG. 6, the prong 24 must be depressed so that wedge shaped element 28 clears the transverse upper first slat 36 while simultaneously the bottom surface of the free end 39 of the flexible prong 24 clears the transverse lower second slat 37. Therefore, the male connector 20 and female connector 30 are unlikely to be susceptible to unintended decoupling or disassembly. This coupling mechanism advantageously permits construction workers to manipulate connected slab bolsters without risk of "inadvertent" decoupling or disengagement when applying non-damaging levels of force that are circumstantially aligned with a simple coupling mechanism, as is possible with many slab bolsters within the prior art.

Having described the invention in detail and by reference to the preferred embodiments, it will be apparent that modifications and variations thereof are possible without departing from the scope of this disclosure.

What is claimed is:

1. A plurality of slab bolster elements, each comprising:

a bolster frame member having a male connector disposed on a first end and a female connector disposed on an opposite end;

said male connector including first and second outer prongs for engaging a complementary female connector and said female connector including first and second opposing side walls with first and second transverse slats extending between said side walls so as to form a socket for receiving a complementary male connector;

said male connector further including a flexible prong extending inwardly between said outer prongs, the flexible prong including a free inward end and a wedge element configured to, in use, resiliently contact and lockingly engage the first transverse slat of another of said plurality of slab bolster elements, wherein said free inward end projects beyond said wedge element and is configured to blockingly abut the second transverse slat of said another bolster element to prevent withdrawal of said male connector from the female connector of said another bolster element if said flexible prong is depressed excessively;

wherein said male connector may lockingly engage the female connector of said another bolster element when inserted into said female connector of said second another bolster element.

2. The plurality of slab bolster elements of claim 1, wherein said outer prongs are resilient and include projections configured to, in use, lockingly engage the first and second opposing side walls of said another bolster element.

3. The plurality of slab bolster elements of claim 1, wherein said female connector includes third and fourth transverse slats extending between said first and second opposing side walls, said first slat being provided longitudinally outward of said third slat and being separated from said third slat by a first transverse gap configured to receive the wedge element of said another bolster element, and second slat being provided longitudinally outward of said fourth slat and being separated from said fourth slat by a second transverse gap configured to receive the flexible prong of said another bolster element.

4. The plurality of slab bolster elements of claim 3, wherein the combined longitudinal length of said free inward end and said wedge element is less than the longitudinal length of said second transverse gap.

5. The plurality of slab bolster elements of claim 3, wherein said first transverse gap and said second transverse gap mutually oppose each other within said socket.

6. The plurality of slab bolster elements of claim 1, wherein said wedge element includes an inclined surface and an inward facing end wall configured so as to permit insertion past said first transverse slat of said another bolster element, but prevent retraction past said first transverse slat of said another bolster element unless said flexible prong and said wedge element are pushed below said first transverse slat of said another bolster element.

7. The plurality of slab bolster elements of claim 6, wherein, in said female connector, said second transverse slat is provided longitudinally outward of a transverse gap, with said free end of said flexible prong of said male connector being depressible into the transverse gap when said end wall is longitudinally inwardly separated from said first transverse slat of the female connector of said another bolster element.

8. The plurality of slab bolster elements of claim 7, wherein, in said female connector, said second transverse slat is provided longitudinally outward of said first transverse slat, and said free end of said flexible prong extends over said second transverse slat of said another bolster element when said end wall is lockingly engaged with said first transverse slat of said another bolster element.

9. A continuous slab bolster assembly comprising:

a first bolster frame member having a male connector and a second bolster frame member having a female connector;

said male connector including first and second outer prongs projecting longitudinally within said female connector, and said female connector including first and second opposing side walls projecting longitudinally over said first and second outer prongs, respectively, with first and second transverse slats interconnecting said side walls on opposite sides of said outer prongs;

said male connector further including a flexible prong extending inwardly between said outer prongs, the flexible prong including a free inward end and a wedge element lockingly retained within said female connector by said first transverse slat, wherein said free inward end projects beyond said wedge element and may blockingly abut said second transverse slat to prevent withdrawal of said male connector from said female connector if said flexible prong is depressed excessively when said wedge element is spaced apart from said first transverse slat;

wherein said male connector may be released by pushing said flexible prong and said wedge shaped member below said first transverse slat.

10. The continuous slab bolster assembly of claim 9, wherein said outer prongs are resilient and include projections lockingly engaging said first and second opposing side walls, respectively.

11. The continuous slab bolster assembly of claim 9, wherein said wedge element includes an inclined surface and an inward facing end wall, the end wall preventing retraction past said first transverse slat unless said flexible prong and said wedge element are pushed below said first transverse slat.

12. The continuous slab bolster assembly of claim 11, wherein, in said female connector, said second transverse slat is provided longitudinally outward of a transverse gap, with said free end of said flexible prong of said male connector being depressible into said transverse gap when said end wall is longitudinally inwardly separated from said first transverse slat.

13. The continuous slab bolster assembly of claim 12, wherein, in said female connector, said second transverse slat is provided longitudinally outward of said first transverse slat, and said free end of said flexible prong extends over said second transverse slat when said end wall is engaged with said first transverse slat.

14. The continuous slab bolster assembly of claim 9, wherein said female connector includes third and fourth transverse slats extending between said first and second opposing side walls, said first slat being provided longitudinally outward of said third slat and being separated from said third slat by a first transverse gap configured to receive said wedge element, and second slat being provided longitudinally outward of said fourth slat and being separated from said fourth slat by a second transverse gap configured to receive said flexible prong.

15. The continuous slab bolster assembly of claim 14, wherein said wedge element is lockingly retained within said female connector by said third transverse slat, and said male connector may be partially released by pushing said flexible prong and said wedge shaped member below said third transverse slat.

16. The continuous slab bolster assembly of claim 14, wherein the combined longitudinal length of said free inward end and said wedge element is less than the longitudinal length of said second transverse gap.

17. The continuous slab bolster assembly of claim 14, wherein said first transverse gap and said second transverse gap mutually oppose each other across said flexible prong.

* * * * *